US005799420A

United States Patent [19]

Kubicz et al.

[11] Patent Number: 5,799,420

[45] Date of Patent: Sep. 1, 1998

[54] STEAM IRON WATER TANK WITH AIR TRAP AND GEAR MOUNTS

[75] Inventors: Edward M. Kubicz, Torrington; Michael J. Marchetti, Bridgeport, both of Conn.

[73] Assignee: Black & Decker Inc., Newark, Del.

[21] Appl. No.: 781,875

[22] Filed: Jan. 10, 1997

[51] Int. Cl.[6] ..... D06F 75/18; D06F 75/24

[52] U.S. Cl. ..... 38/77.7; 38/77.8

[58] Field of Search ..... 38/77.8, 77.82, 38/88, 77.7, 77.3, 77.2, 77.4, 77.5, 77.81; 219/245, 250

[56] References Cited

U.S. PATENT DOCUMENTS

| | | | |
|---|---|---|---|
| 2,342,653 | 2/1944 | Edwards . | |
| 2,441,586 | 5/1948 | Morton | 38/77.7 |
| 2,903,804 | 9/1959 | Kistner . | |
| 2,952,086 | 9/1960 | Kistner et al. | 38/77.83 |
| 2,976,627 | 3/1961 | Kistner et al. | 38/77.83 X |
| 2,981,017 | 4/1961 | Tesmer et al. . | |
| 3,224,122 | 12/1965 | Jepson et al. | 38/77.2 |
| 4,656,763 | 4/1987 | Kawasaki et al. | 38/77.83 |
| 4,661,685 | 4/1987 | Contri | 219/250 |
| 4,686,352 | 8/1987 | Nawrot et al. | 219/250 |
| 4,688,339 | 8/1987 | Tsai | 38/77.82 X |
| 4,688,340 | 8/1987 | Ostrelich | 38/90 |
| 4,748,755 | 6/1988 | Bain, Jr. et al. | 38/88 |
| 4,870,763 | 10/1989 | Campbell | 38/77.7 |
| 5,042,179 | 8/1991 | van der Meer | 38/77.83 |
| 5,138,778 | 8/1992 | Brandolini | 38/77.8 |
| 5,404,662 | 4/1995 | Patrick et al. | 38/77.82 |

FOREIGN PATENT DOCUMENTS

| | | |
|---|---|---|
| 83305379.6 | 3/1984 | European Pat. Off. . |
| 1 039 987 | 7/1960 | Germany . |
| 1 878 818 | 5/1963 | Germany . |

*Primary Examiner*—Ismael Izaguirre
*Attorney, Agent, or Firm*—Barry E. Deutsch

[57] ABSTRACT

A steam iron having a water tank with an internal air trap and external gear mounts. The air trap holds a volume of air when the iron is being filled with water, but receives water when the iron is moved to a horizontal position to prevent water from spilling out of a water fill spout. The iron has gears that connect a temperature control of the iron to a water metering valve. The gears are stabily rotatably mounted directed to the water tank on the gear mounts.

19 Claims, 5 Drawing Sheets

STEAM IRON WATER TANK WITH AIR TRAP AND GEAR MOUNTS

BACKGROUND OF THE INVENTION

1. Field of the Invention

The present invention relates to steam irons and, more particularly, to a steam iron with an improved water tank.

2. Prior Art

U.S. Pat. No. 4,688,340 discloses an iron with a water reservoir in a handle. U.S. Pat. No. 5,138,778 discloses a water reservoir with a large rear portion. U.S. Pat. No. 5,138,778 discloses an open area in a top, middle of a water tank. U.S. Pat. No. 4,870,763 discloses a housing with a sliding gear mounting area. U.S. Pat. No. 4,688,340 discloses a knob mounted on a raised ring surface.

SUMMARY OF THE INVENTION

In accordance with one embodiment of the present invention, a steam iron is provided comprising a soleplate, means for heating the soleplate, and a water tank for holding water to be delivered onto the soleplate. The improvement comprises the water tank having a water fill inlet that is connected to a water fill spout of the iron, and wherein a portion of a water holding volume of the water tank is located above a portion of the water fill spout when the iron is in a horizontal position. The water tank further comprises an air trap that holds a volume of air when the iron is in a vertical position and being filled with water. The air trap receives water when the iron is moved to a horizontal position to prevent water from spilling out of the fill spout.

In accordance with another embodiment of the present invention, a steam iron is provided having a soleplate, means for heating the soleplate, a water tank for holding water to be delivered onto the soleplate, and gears connecting a temperature control of the iron to a water metering valve between the water tank and the soleplate. The improvement comprises the water tank having integral gear mounts for rotatably mounting the gears onto the water tank.

In accordance with another embodiment of the present invention, a steam iron is provided comprising a soleplate, means for heating the soleplate, a water tank for holding water to be delivered onto the soleplate, and gears for connecting a temperature control of the iron to a water metering valve between the water tank and the soleplate. The improvement comprises the water tank having an air trap and integral gear mounts. The air trap holds a volume of air when the iron is in a vertical position and is being filled with water. The air trap receives water when the iron is moved to a horizontal position to prevent water from spilling out of a water fill spout. The integral gear mounts have the gears rotatably mounted thereon to stabily mount the gears directly on the water tank.

BRIEF DESCRIPTION OF THE DRAWINGS

The foregoing aspects and other features of the invention are explained in the following description, taken in connection with the accompanying drawings, wherein.

DETAILED DESCRIPTION OF THE PREFERRED EMBODIMENT

Figure 1:
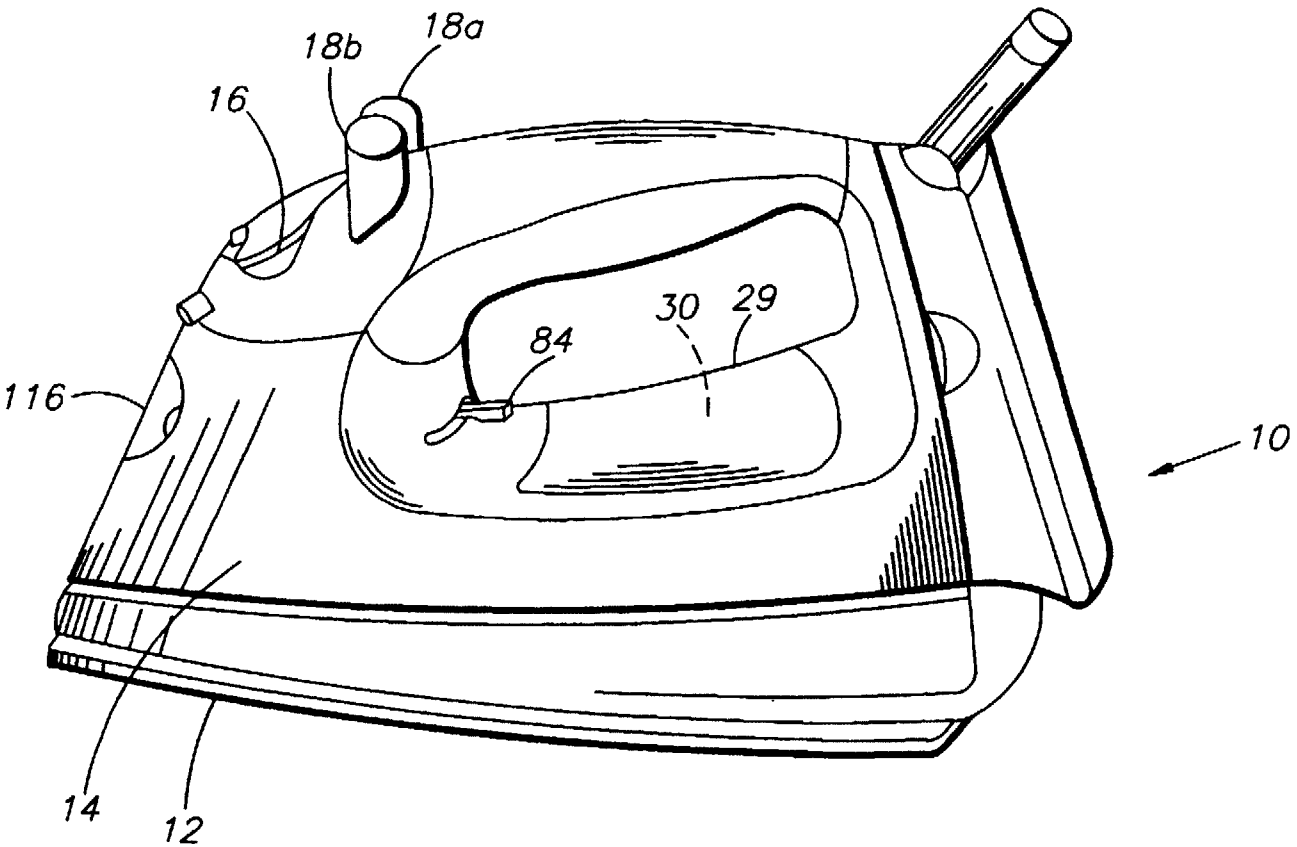
FIG. 1 is a perspective view of an iron incorporating features of the present invention.

Referring to FIG. 1, there is shown a perspective view of a steam iron 10 incorporating features of the present invention. Although the present invention will be described with reference to the single embodiment shown in the drawings, it should be understood that features of the present invention can be embodied in various alternative embodiments of steam irons. In addition, any suitable size, shape or type of elements or materials could be used.

Figure 2:
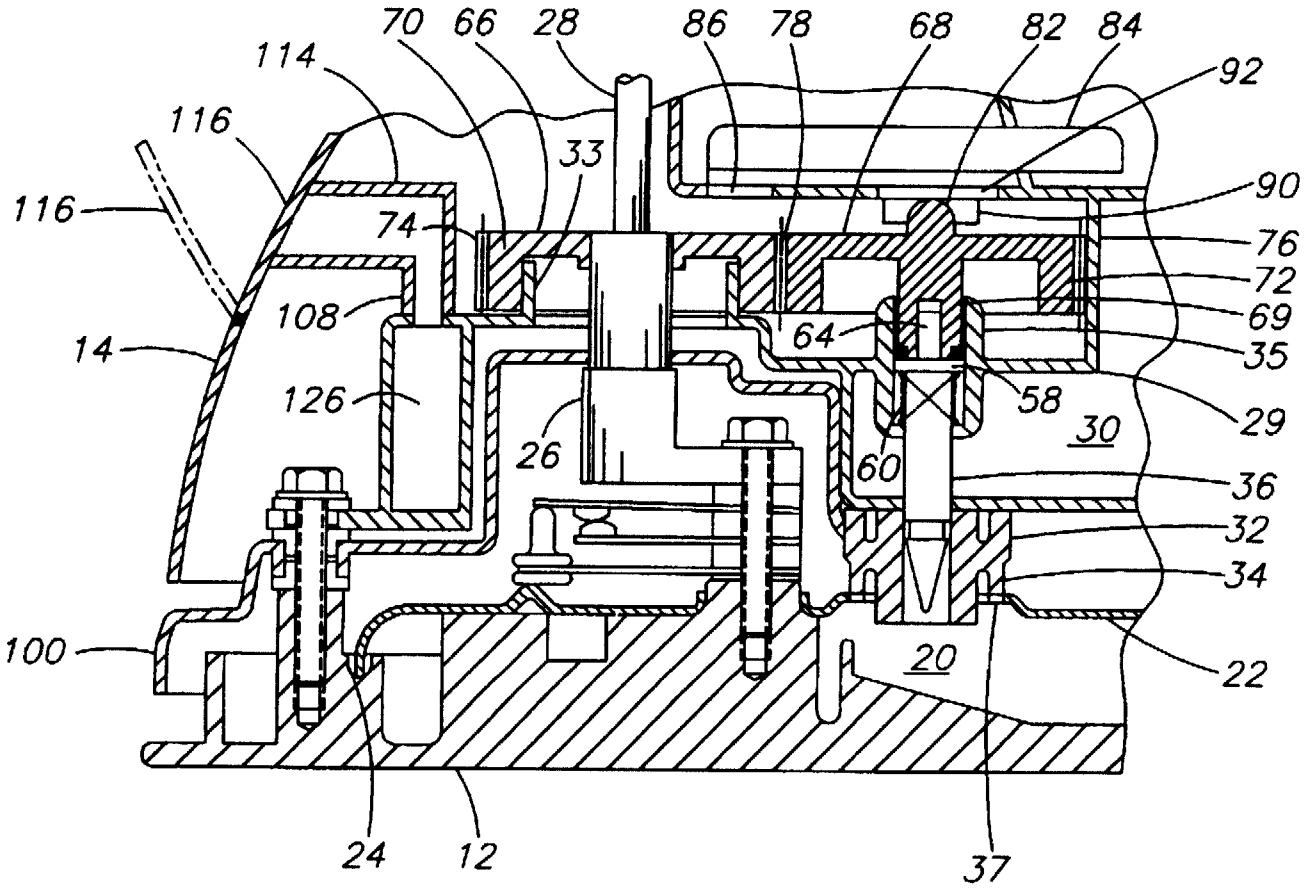
FIG. 2 is a schematic cross-sectional view of the lower front portion of the iron shown in FIG. 1.

The iron 10 generally comprises a soleplate 12, a housing 14, a temperature control knob 16, a spray button **18*a* and a surge button 18*b*. Referring also to FIG. 2 a partial cross-sectional view of the front of the iron is shown. The soleplate 12 has a raised wall 24 in a general triangular shape that forms the side walls for the steam chamber 20. A cover 22 is attached to the top of the wall 24 to form the top of the steam chamber. A thermostat 26 is mounted on the soleplate 12 and connected to the temperature control knob 16 by the shaft 28. The housing 14 includes a water tank 29 that forms a water reservoir 30. A valve 32 is provided between the reservoir 30 and the soleplate 12**.

The valve 32 includes a valve body or member 34 and a valve stem 36. The valve member 34 is mounted on the steam chamber cover 22 and forms a valve seat 37. The water metering valve is described in greater detail in U.S. patent application Ser. No. 08/716,962 which is hereby incorporated by reference in its entirety. The top section of the stem 36 has a rim 58 and a stud 64. The temperature control shaft 28 is connected to the valve stem 36 by two gears 66, 68. The first gear 66 is connected to the shaft 28 such that axial rotation of the shaft 28 axially rotates the first gear 66. The second gear 68 is mounted on the top stud 64 of the valve stem 36. The two gears 66, 68 have relatively broad outer perimeters 70, 72 with teeth 74, 76, respectively. The teeth 74, 76 are intermeshed at a junction 78 of the two gears. The stud 64 has a keyed shape. The bottom center of the second gear 68 has a keyed aperture. The stud 64 is located in the aperture such that axial rotation of the second gear 68 axially rotates the valve stem 36. A spring 60 is provided in a spring cavity. The spring 60 is in contact with the bottom of the rim 58 and biases the valve stem 36 in an upward direction. The bottom of the second gear's center rests against the top of the rim 58. Therefore, the second gear 68 is also biased in an upward direction. The top center of the second gear 68 has a rider protrusion 82. As seen best in FIGS. 1 and 2, mounted to the housing 14 is a user actuatable selector 84. The selector 84 is a lever pivotally mounted to the housing 14 at pivot 86 and movably captured by a portion of the housing 14. Located on the bottom of the selector 84 is a cam section 90 that projects through a hole 92 in the housing 14. The biasing action of the spring 60 biases the rider protrusion 82 against the bottom surface of the cam section 90. The bottom surface of the cam section 90 forms a cam surface.

Figure 3:
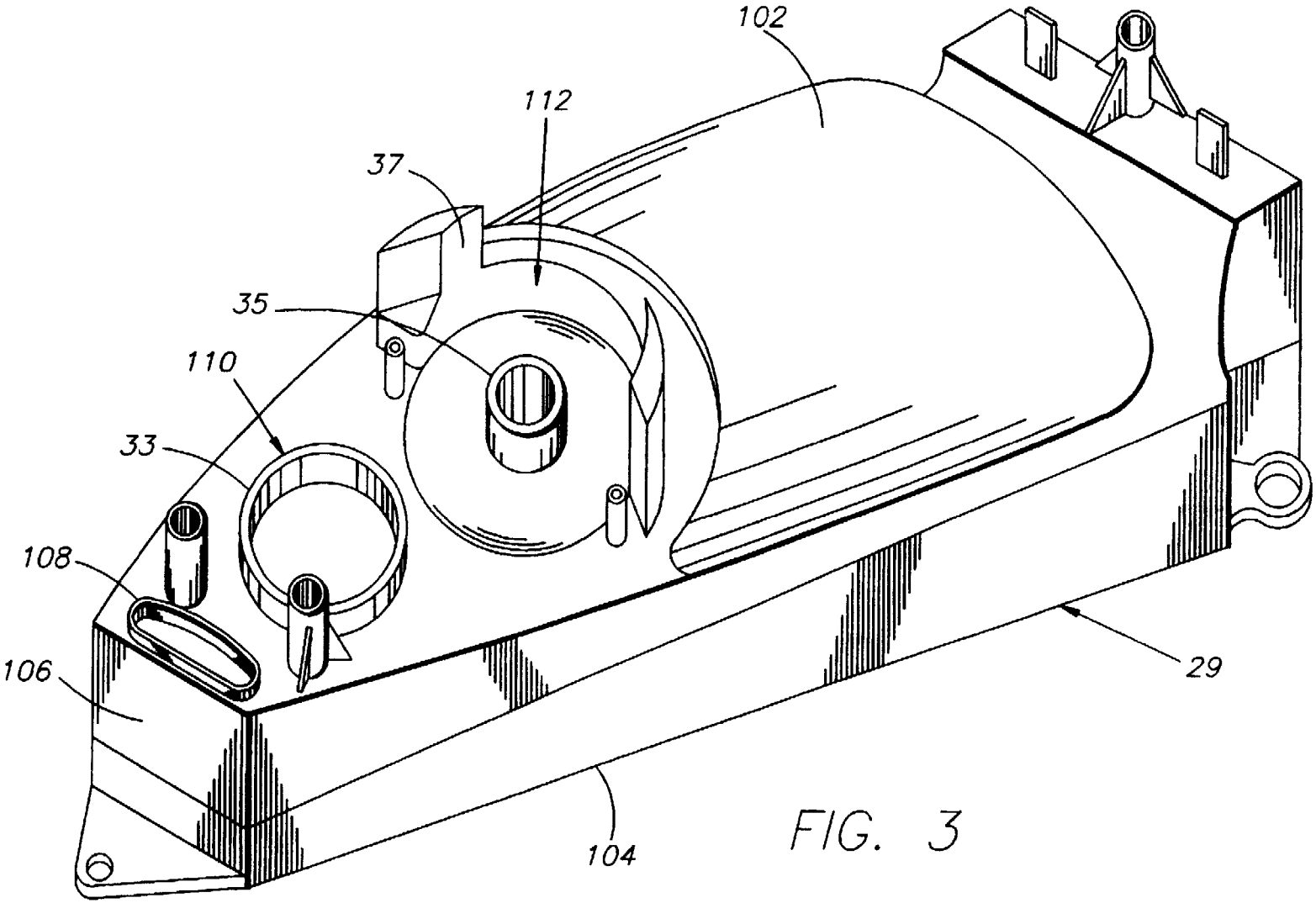
FIG. 3 is a perspective view of the water tank used in the iron shown in FIG. 1.

A skirt 100 is mounted on the soleplate. On top of the skirt 100 is the water tank 29. Referring also to FIG. 3, a perspective view of the water tank 29 is shown. The water tank 29 is comprised of two pieces; a top piece 102 and a bottom piece 104. The top piece 102 includes a front end 106 with a water fill inlet 108. The water fill inlet 108 is connected to a fill spout 114 of the housing 14. In the embodiment shown, the housing 14 has a pivotable door 116 that covers the entrance to the fill spout 114. The top piece 102 also includes two integral gear mounts 110 and 112. The first integral gear mount 110 has a raised ring or collar 33. The second integral gear mount 112 has a second raised ring or collar 35 and a raised perimeter shell 37. The first collar 33 has the first gear 66 stabily rotatably mounted directly thereon. The second gear mount 112 has the second gear 68 stabily rotatably mounted directly thereon. More specifically, the bottom center 69 of the second gear 68 projects into the second raised collar 35 and a majority of the side perimeter of the second gear 68 is supported by the raised perimeter shell 37. The second gear mount 112 is adapted to allow the second gear 68 to longitudinally move up and down in the second gear mount 112.

Figure 4:
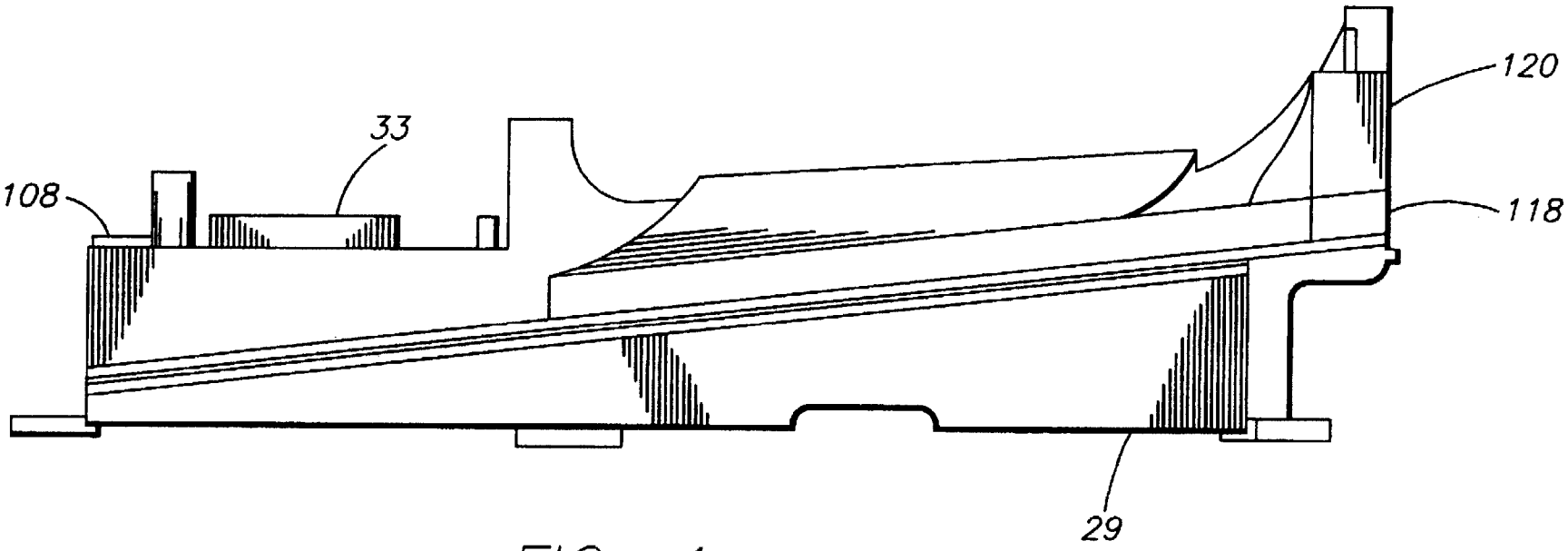
FIG. 4 is an elevational side view of the water tank shown in FIG. 3.
Figure 5:
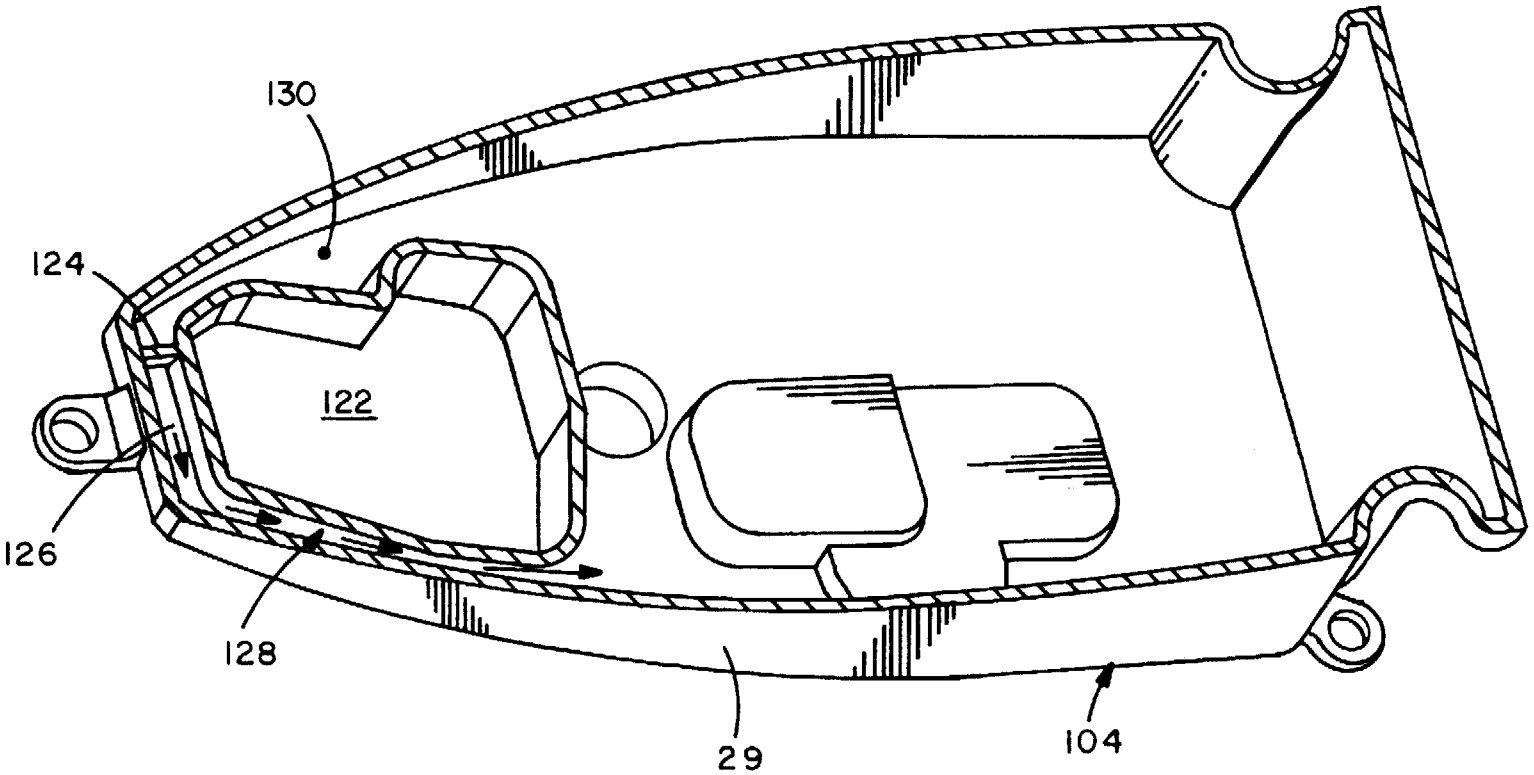
FIG. 5 is a cross-sectional view of the water tank shown in FIG. 3.

Referring also to FIG. 4, an elevational side view of the water tank 29 is shown. The rear end 118 of the water tank 29 has an elevated section 120. The elevated section 120 has a portion of the reservoir or water holding volume of the water tank. With the iron in a horizontal position, the elevated section 120 is located above, at least partially, the water fill inlet 108 and the fill spout 114. A portion of the water holding volume is thus located above the fill spout 114 when the iron is in a horizontal position. In order to prevent water from spilling out the fill spout 114, after the tank is filled with water and moved to a horizontal position, the water tank 29 has been provided with an air trap that functions as a spill dampener. Referring also to FIG. 5, a perspective cross-sectional view of the water tank 29 is shown. The front of the water tank 29 has a thermostat receiving area 122 extending up from its bottom. The front of the tank also has a dividing wall 124. The tank 24 thus forms a water entry point 126, a left side water entry flow path 128, and a right side air trap 130.

In order to fill the iron with water, the user opens the door 116 and places the fill spout under a water faucet in a generally vertical position. Water from the faucet enters the tank at the inlet 108, into the entry point 126 and down the flow path 128. As the water fills the reservoir 30, it forms an air pocket in the air trap 130. This air pocket prevents water from entering the air trap 130 while the iron is being filled with water. After the tank 29 is filled, the user closes the door 116 and can move the iron to a horizontal position for ironing. When the iron is moved towards a horizontal position the water in the elevated section 120 moves down and is replaced by the air from the air trap 130. The air trap 130 thus now receives water to substantially prevent the water from spilling out the fill spout 114.

The elevated section 120 of the water tank 29 has been provided to increase the water holding capacity of the water tank 29 without increasing the length and width of the tank. To compensate for the possible problem of spilling of water out of the iron when the iron is moved to a horizontal position, the air trap 130 has been provided. Thus, the water tank can have a water holding volume located above the water entry fill spout of the iron to increase the water holding capacity of the tank without increasing the size of its footprint.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. In a steam iron having a soleplate, means for heating the soleplate, and a water tank for holding water to be delivered onto the soleplate, wherein the improvement comprises:

the water tank having a water fill inlet, the inlet being connected to a water fill spout of the iron, a portion of a water holding volume of the water tank being located above a portion of the water fill spout when the iron is in a horizontal position, and the water tank further comprising an air trap that holds a volume of air when the iron is in a vertical position and being filled with water, wherein the air trap receives water when the iron is moved to a horizontal position to prevent water from spilling out the fill spout.

2. An iron as in claim 1 wherein the water fill inlet is at a first end of the water tank and the portion of the water holding volume located above the fill spout is located at an opposite second end of the water tank.

3. An iron as in claim 2 wherein the air trap is located at the first end of the water tank.

4. An iron as in claim 3 wherein the water tank has an area proximate the first end for receiving a portion of a thermostat of the iron and wherein the air trap is located on a first side of the thermostat receiving area and a water entry path from the water fill inlet is located on a second opposite side of the thermostat receiving area.

5. An iron as in claim 1 wherein the water tank further comprises integral gear mounts for stabily mounting gears directly onto the water tank.

6. An iron as in claim 5 wherein a first one of the gear mounts comprises a first raised collar for rotatably mounting a first gear directly on the raised collar.

7. An iron as in claim 6 wherein a second one of the gear mounts comprises a raised perimeter shell surrounding a majority of a side perimeter of a second gear.

8. An iron as in claim 7 wherein the second gear mount further comprises a second raised collar with the second gear directly rotatably mounted on the second raised collar.

9. In a steam iron having a soleplate, means for heating the soleplate, a water tank for holding water to be delivered onto the soleplate, and gears connecting a temperature control of the iron to a water metering valve between the water tank and the soleplate, wherein the improvement comprises:

the water tank having integral gear mounts for rotatably mounting the gears onto the water tank; and a first one of the gear mounts comprises a first raised collar for rotatablv mounting a first gear directly on the raised collar.

10. An iron as in claim 9 wherein a second one of the gear mounts comprises a raised perimeter shell surrounding a majority of a side perimeter of a second gear.

11. An iron as in claim 10 wherein the second gear mount further comprises a second raised collar with the second gear directly rotatably mounted on the second raised collar.

12. An iron as in claim 11 wherein the second gear is longitudinally movable on the second raised collar and along the raised perimeter shell.

13. An iron as in claim 12 wherein the water tank further comprises an air trap for retaining a volume of air while the water tank is being filled with water.

14. In a steam iron having a soleplate, means for heating the soleplate, a water tank for holding water to be delivered onto the soleplate, and gears connecting a temperature control of the iron to a water metering valve between the water tank and the soleplate, wherein the improvement comprises:

the water tank having an air trap and integral gear mounts, wherein the air trap holds a volume of air when the iron is in a vertical position and is being filled with water, wherein the air trap receives water when the iron is moved to a horizontal position to prevent water from spilling out of a water fill spout, and wherein the integral gear mounts have the gears rotatably mounted thereon to stabily mount the gears directly on the water tank.

15. An iron as in claim 14 wherein a water fill inlet of the water tank is at a first end of the water tank and a portion of a water holding volume of the water tank which is located above the water fill spout is located at an opposite second end of the water tank.

16. An iron as in claim 15 werein the air trap is located at the first end of the water tank.

17. An iron as in claim 16 wherein the water tank has an area proximate the first end for receiving a portion of a thermostat of the iron and wherein the air trap is located on a first side of the thermostat receiving area and a water entry path from the water fill inlet is located on a second opposite side of the thermostat receiving area.

18. An iron as in claim 14 wherein a first one of the gear mounts comprises a first raised collar for rotatably mounting a first gear directly on the raised collar.

19. An iron as in claim 18 wherein a second one of the gear mounts comprises a raised perimeter shell surrounding a majority of a side perimeter of a second gear.

* * * * *